US009828941B2

(12) United States Patent
Song

(10) Patent No.: US 9,828,941 B2
(45) **Date of Patent: *Nov. 28, 2017**

(54) VALVED STIRLING ENGINE WITH IMPROVED EFFICIENCY

(71) Applicant: Kevin Song, Lexington, MA (US)

(72) Inventor: Kevin Song, Lexington, MA (US)

( * ) Notice: Subject to any disclaimer, the term of this patent is extended or adjusted under 35 U.S.C. 154(b) by 132 days.

This patent is subject to a terminal disclaimer.

(21) Appl. No.: 14/800,917

(22) Filed: Jul. 16, 2015

(65) Prior Publication Data

US 2015/0315997 A1 Nov. 5, 2015

Related U.S. Application Data

(63) Continuation of application No. 14/054,522, filed on Oct. 15, 2013, now Pat. No. 9,109,534.

(51) Int. Cl.
*F02G 1/057* (2006.01)
*F02G 1/053* (2006.01)
(Continued)

(52) U.S. Cl.
CPC ..... *F02G 1/057* (2013.01); *F02G 1/044* (2013.01); *F02G 1/045* (2013.01); *F02G 1/053* (2013.01);
(Continued)

(58) Field of Classification Search
CPC ..... F02G 1/057; F02G 1/053; F02G 1/055; F02G 1/045; F02G 1/044; F02G 2270/90; F02G 2243/08; F02G 2243/30; F02G 2243/00; F02G 2255/00; F02G 2243/02; F02G 2256/00; F02G 2257/00
(Continued)

(56) References Cited

U.S. PATENT DOCUMENTS 1,306,865 A 6/1919 Stoddard
1,926,463 A 7/1923 Stoddard
(Continued)

OTHER PUBLICATIONS

Nightingale; "Automotive Stirling Engine, Mod II Design Report"; Oct. 1986; National Aeronautics and Space Administration; NASA CR-175106; 54 pp.
(Continued)

*Primary Examiner* — Hoang Nguyen
(74) *Attorney, Agent, or Firm* — Fish & Richardson P.C.; Frank L. Gerratana

(57) ABSTRACT

A Stirling engine can take advantage of adiabatic compression (which heats working gas leaving the cold cylinder) and adiabatic expansion (which cools working gas leaving the hot cylinder) to increase efficiency. In some implementations, partially-heated gas leaving the cold cylinder and partially-cooled gas leaving the hot cylinder can be routed directly to a regenerator using bypass paths that are opened using one-way valves. The resultant relatively reduced temperature difference across the regenerator, e.g., as compared to a typical Stirling engine, can reduce thermal loss and improve efficiency. In some implementations, the compression ratios of the Stirling engine can be adjusted such that the temperature of the adiabatic heated gas is the same or higher than the temperature of the adiabatic cooled temperatures, thus eliminating the need for a regenerator.

20 Claims, 11 Drawing Sheets

(51) Int. Cl.
*F02G 1/044* (2006.01)
*F02G 1/045* (2006.01)
*F02G 1/055* (2006.01)

(52) U.S. Cl.
CPC ..... *F02G 1/055* (2013.01); *F02G 2243/00* (2013.01); *F02G 2243/02* (2013.01); *F02G 2243/08* (2013.01); *F02G 2243/30* (2013.01); *F02G 2255/00* (2013.01); *F02G 2256/00* (2013.01); *F02G 2257/00* (2013.01); *F02G 2270/90* (2013.01)

(58) Field of Classification Search
USPC ..... 60/517–526
See application file for complete search history.

(56) References Cited

U.S. PATENT DOCUMENTS

| | | | | |
|---|---|---|---|---|
| 2,067,453 | A | 1/1937 | Lee | |
| 2,685,173 | A | 8/1954 | Percival | |
| 3,174,276 | A | 3/1965 | Baker | |
| 3,180,081 | A | 4/1965 | Baker | |
| 3,200,581 | A | 8/1965 | Weiland | |
| 3,216,190 | A | 11/1965 | Baker | |
| 4,366,676 | A * | 1/1983 | Wheatley | F02G 1/0445 505/895 |
| 9,109,534 | B2 * | 8/2015 | Song | F02G 1/044 |

OTHER PUBLICATIONS

Cairelli et al.; "Initial test Test Results with a Single-Cylinder Rhombic-Drive Stirling Engine"; U.S. Department of Energy; Jul. 1978; 42 pp.
Brzeski et al. "Experimental Investigations of the Externally Heated Valve Engine Model"; Feb. 2001; *Institute of Turbomachinery*; pp. 487-494.
Brzeski and Kazimierski, "A New Concept of Externally Heated Engin—Comparisons with the Stirling Engine," *Proceedings of the Institution of Mechanical Engineers, Part A: Journal of Power and Energy*; 1996; 10 pp., retrieved at http://pia.sagepub.com/content/210/5/363 (Abstract).
Kazimierski et al.; "Externally Heated ValveEngine—An Alternative to the Stirling Enging"; *IEEE*; 1996; pp. 1320-1324.
EPA: United States Environmental Protection Agency, "Global Greenhouse Gas Emissions Data," posted on or about Jun. 14, 2012, retrieved on Jan. 16, 2014, http://www.epa.gov/climatechange/ghgemissions/global.html , 4 pages.
Kruger et al.; "Efficiency in Electricity Generation; Jul. 2003; Union of the Electricity Industry—Eurelectric," *BGB Power Tech*, 1-30.
The Daily Green, "Deam Kamen's DEKA Revolt: An Electric Car with a Stirling Engine," Nov. 14, 2008, retrieved on Jan. 16, 2014, http://www.thedailygreen.com/living-green/blogs/cars-transportation/dean-kamen-deka-revolt-electric-car-stirling-461108, 4 pages.
Stirling Engine, posted on or before Aug. 4, 2008, retrieved on Jan. 16, 2014, http://www.microchp.nl/stirling_engine.htm, 1 page.
Wikipedia, "Stirling Engine," posted on or before Feb. 22, 2003, retrieved on Jan. 16, 2014, http://en.wikipedia.org/wiki/Stirling_Engine, 21 pages.
Electropedia, "Energy conversion and Heat Engines (With a Little Bit of Thermodynamics," posted on or before Jul. 20, 2011, retrieved on Jan. 16, 2014, http://www.mpoweruk.com/heat_engines.htm , 7 pages.
Stirling Engine Welcome Page, posted on or before Apr. 30, 2011, retrieved on Jan. 16, 2014, http://www.robertstirlingengine.com/, 3 pages.
Blog for newenergydirection.com, "Renewable Energy Systems: Stirling Engine Efficiency," posted on or before Jul. 15, 2009, retrieved on Jan. 16, 2014, http://newenergydirection.com/blog/2009/06/stirling-engine-efficiency/, 2 pages.
Martini, et al.; "Stirling Engine Design Manual Second Edition"; NASA 1983; Chapter 5; 60-133pp.
Abbas et al.; Thermal performances of Stirling engine solar driven; Revue des Energies Renouvelables; CICME'08 Sousse (2008) 1-10.
Finkelstein, "Generalized thermodynamic analysis of Stirling engines," *SAE Technical Paper* 600222, 1960, 1 page, retrieved from http://papers.sae.org/600222/ (Abstract).
Asnaghi et al.; "Thermodynamics Performance Analysis of Solar Stirling Engines," *ISRN Renewable Energy*, 2012, article ID 321923, 14 pages retrieved from http://www.hindawi.com/isrn/re/2012/321923/.
Strol, Hemmings Daily, "Found: NASA's Stiling-engined Dodge D-150," Aug. 26, 2010, retrieved on Jan. 16, 2014, http://blog.hemmings.com/index.php/2010/08/26/found-nasas-stirling-engined-dodge-d-150, 9 pages.
Oelrich et al., "Evaluation of Potential Military Applications of Stirling Engines"; *Institute for Defense Analyses*, Jul. 1988, 89 pages.
Wikipedia, "Stoddard Engine," posted on or before May 18, 2007, retrieved on Jan. 16, 2014, http://en.wikipedia.org/wiki/Stoddard_engine#/cite_note-patent1933-1, 3 pages.
Wojewoda et al., "Numerical model and investigations of the externally heated valve Joule engine," Energy, May 2010, 35(10):2099-2108.
News Release, "Sandi, Stirling Energy Systems set new world record for solar-to-grid conversion efficiency," Feb. 12, 2008, retrieved Jan. 16, 20104, https://share.sandia.gov/news/resources/releases/2008/solargrid.html , 3 pages.
Kongtragool, et al.; "Performance of low-temperature differential Stirling engines"; *Renewable Energy*; 2004; pp. 547-566.
Yusof, et al.; "Preliminary Investigation of a Converted Four-Stroke Diesel to Alpha Stirling Engine"; *Asian Journal of Applied Sciences* 2 (2): 101-114, 2009.
NEST New Energy Systems Trust, "Directory: Stirling Engines," posted on or before Dec. 17, 2005, retrieved Jan. 16, 2014, http://peswiki.com/index.php/Directory:Stirling_Engine , 8 pages.
Wheatley et al.; "The Natural Heat Engine"; Fall 1986; Los Alamos Science; 1-32.
Thimsen; "Stirling Engine Assessment"; *2002 Electric Power and Research Institute, Inc.*; 170 pages.
Revetec, "Home of the World's Most Efficient Gasoline Engine," posted on or before Apr. 29, 1999, retrieved on Jan. 16, 2014, www.revetec.com, 1 page.
Crowley; "Efficiency Terms for Stirling Engine Systems"; (1983); *Oak Ridge National Laboratory*; 37 pages.
"Table 1: Values of basic engine parameters," retrieved on Jan. 16, 2014, http://www.hindawi.com/isrn/re/2012/321923/tab1/, 1 page.
Kongtragool and Wongwises, "Thermodynamic analysis of a Stirling engine including dead volumes of hot space, cold space and regenerator," *Renewable Energy*, Mar. 2006, 31(3):345-359, retrieved from http://www.sciencedirect.com/science/article/pii/S0960148105000765 (Abstract).
US Department of Energy, "Fuel Economy: Where the Energy Goes," posted on or before Feb. 29, 2000, retrieved on Jan. 16, 2014, http://www.fueleconomy.gov/feg/atv.shtml, 1 page.
Fryer; "Design, Construction, and Testing of a New Valved, Hot-Gas Engine"; *Massachusetts Institute of Technology*, Feb. 1973; 1-229.
Ernst, et al.; *Automotive Stirling Engine Development Project*; Feb. 1997; 172 pages.
Brzeski et al., "A New Concept of Externally Heated Engine—Comparisons with the Stirling Engine," *Proceedings of the Institution of Mechanical Engineers, Part A: Journal of Power and Energy*,1996, 363-371.

* cited by examiner

VALVED STIRLING ENGINE WITH IMPROVED EFFICIENCY

CROSS REFERENCE TO RELATED APPLICATIONS

This application is a continuation of and claims benefit to U.S. application Ser. No. 14/054,522, filed on Oct. 15, 2013. The application is incorporated by reference in its entirety.

TECHNICAL FIELD

This invention relates to a Stirling engine.

BACKGROUND

A Stirling engine operates by cyclically compressing and expanding a working gas within a closed system. For example, the system could be made up of a cold cylinder, a hot cylinder, a cooling tube, a heating tube, and a regenerator (which captures thermal energy stored in the working gas). In a conventional Stirling engine, the working gas (e.g., air) travels from the cold cylinder to hot cylinder as the cold cylinder compresses the working gas. The working gas passes through the cooling tube, the regenerator, and the heating tube before reaching the hot cylinder. Working gas then travels from the hot to cold cylinder as the hot cylinder expands, and traverses the reverse path. In this way, the working gas leaving the cold cylinder is cooled by the cooling tube before being heated by the regenerator and heating tube. Similarly, gas leaving the hot cylinder is heated by the heating tube before being cooled by the regenerator and cooling tube.

SUMMARY

In general, according to one aspect, a Stirling engine apparatus includes a set of cold bypass tubes, a set of hot bypass tubes, and at least a set of first and a set of second unidirectional valves.

Any of the aspects described below could include more than one cold bypass tube and/or more than one hot bypass tube with corresponding additional unidirectional valves. For example, multiple cold bypass tubes (e.g., arranged in parallel) could be used, and multiple hot bypass tubes (e.g., arranged in parallel) could be used. Multiple regenerators may also be used (e.g., arranged in parallel).

In general, according to another aspect, a Stirling engine apparatus includes a set of flywheels, a cold cylinder, a cooling tube, a hot cylinder, a heating tube, a first piston and a second piston, a regenerator, a cold bypass tube, a hot bypass tube, and a first, second, third, and fourth unidirectional valves; the first piston is attached to at least one flywheel of the set of flywheels; the second piston is attached to at least one flywheel of the set of flywheels; the first piston is at least partially contained in the cold cylinder; the second piston is at least partially contained in the hot cylinder; the cooling tube communicates between the cold cylinder and the regenerator, and where the first unidirectional valve directs a flow of a working gas through the cooling tube towards the cold cylinder and resists a flow of the working gas through the cooling tube towards the regenerator; the cold bypass tube communicates between the cold cylinder and the regenerator, and where the second unidirectional valve directs a flow of the working gas through the cold bypass tube towards the regenerator and resists a flow of the working gas through the cold bypass tube towards the cold cylinder; the heating tube communicates between the hot cylinder and the regenerator, and where the third unidirectional valve directs a flow of the working gas through the heating tube towards the hot cylinder and resists a flow of the working gas through the heating tube towards the regenerator; the hot bypass tube communicates between the hot cylinder and the regenerator, and where the fourth unidirectional valve directs a flow of the working gas through the hot bypass tube towards the regenerator and resists a flow of the working gas through the hot bypass tube towards the hot cylinder; and the apparatus defines a closed system for the working gas.

In general, according to another aspect, a Stirling engine apparatus includes a first piston at least partially contained in a cold cylinder, where the second piston is attached to at least one flywheel of the set of flywheels; a second piston at least partially contained in a hot cylinder, where the second piston is attached to at least one flywheel of the set of flywheels; a cooling tube in communication between the cold cylinder and a regenerator, where a first unidirectional valve directs a flow of a working gas through the cooling tube towards the cold cylinder and resists a flow of the working gas through the cooling tube towards the regenerator; a cold bypass tube in communication between the cold cylinder and the regenerator, where a second unidirectional valve directs a flow of the working gas through the cold bypass tube towards the regenerator and resists a flow of the working gas through the cold bypass tube towards the cold cylinder; a heating tube in communication between the hot cylinder and the regenerator, where a third unidirectional valve directs a flow of the working gas through the heating tube towards the hot cylinder and resists a flow of the working gas through the heating tube towards the regenerator; a hot bypass tube in communication between the hot cylinder and the regenerator, where a fourth unidirectional valve directs a flow of the working gas through the hot bypass tube towards the regenerator and resists a flow of the working gas through the hot bypass tube towards the hot cylinder; and a closed system for the working gas.

In general, according to another aspect, a Stirling engine apparatus includes a set of flywheels, a cold cylinder, a cooling tube, a hot cylinder, a heating tube, a first piston and a second piston, a cold bypass tube, a hot bypass tube, and at least a first and a second unidirectional valve; the first piston is attached to at least one flywheel of the set of flywheels; the second piston is attached to at least one flywheel of the set of flywheels; the first piston is at least partially contained in the cold cylinder; the second piston is at least partially contained in the hot cylinder; the cooling tube communicates between the cold cylinder and the hot cylinder and wherein at least one of the first and second unidirectional valves directs a flow of a working gas through the cooling tube towards the cold cylinder and resists a flow of the working gas from the cold cylinder through the cooling tube towards the hot cylinder; the cold bypass tube communicates between the cold cylinder and the hot cylinder, and wherein at least one of the first and second unidirectional valves directs a flow of the working gas through the cold bypass tube away from the cold cylinder and resists a flow of the working gas through the cold bypass tube towards the cold cylinder; the heating tube communicates between the hot cylinder and the cold cylinder, and wherein at least one of the first and second unidirectional valves regulates a flow of the working gas through the heating tube towards the hot cylinder and resists a flow of the working gas through the heating tube towards the cold cylinder; the hot bypass tube communicates between the hot cylinder and the cold cylinder, and wherein at least one of the first and second unidirectional valves regulates a flow of the working gas through the hot bypass tube away from the hot cylinder and resists a flow of the working gas through the hot bypass tube towards the hot cylinder; and the apparatus defines a closed system for the working gas.

In general, according to another aspect, a Stirling engine apparatus includes a first piston at least partially contained in a cold cylinder, where the first piston is attached to at least one flywheel of a set of flywheels; a second piston at least partially contained in a hot cylinder, where the second piston is attached to at least one flywheel of the set of flywheels; a cooling tube in communication between the cold cylinder and the hot cylinder, where at least one of the first and second unidirectional valves directs a flow of the working gas through the cold bypass tube away from the cold cylinder and resists a flow of the working gas through the cold bypass tube towards the cold cylinder; a heating tube in communication between the hot cylinder and the cold cylinder, where at least one of the first and second unidirectional valves regulates a flow of the working gas through the heating tube towards the hot cylinder and resists a flow of the working gas through the heating tube towards the cold cylinder; a hot bypass tube in communication between the hot cylinder and the cold cylinder, where at least one of the first and second unidirectional valves directs a flow of the working gas through the hot bypass tube away from the hot cylinder and resists a flow of the working gas through the hot bypass tube towards the hot cylinder; and a closed system for the working gas.

DETAILED DESCRIPTION

The manner in which the working gas of a Stirling engine is cooled and heated within its path can be a source of inefficiency (e.g., loss of energy as the engine operates). A Stirling engine can take advantage of adiabatic compression (which heats working gas leaving the cold cylinder) and adiabatic expansion (which cools working gas leaving the hot cylinder) to increase efficiency. In some implementations, partially-heated gas leaving the cold cylinder and partially-cooled gas leaving the hot cylinder can be routed directly to the regenerator using bypass paths that are opened using one-way valves. The resultant relatively reduced temperature difference across the regenerator, e.g., as compared to a typical Stirling engine, can reduce thermal loss and improve efficiency. In some implementations, the compression ratios of the Stirling engine can be adjusted such that the temperature of the adiabatic heated gas is the same or higher than the temperature of the adiabatic cooled temperatures, thus eliminating the need for a regenerator.

Figure 1A:
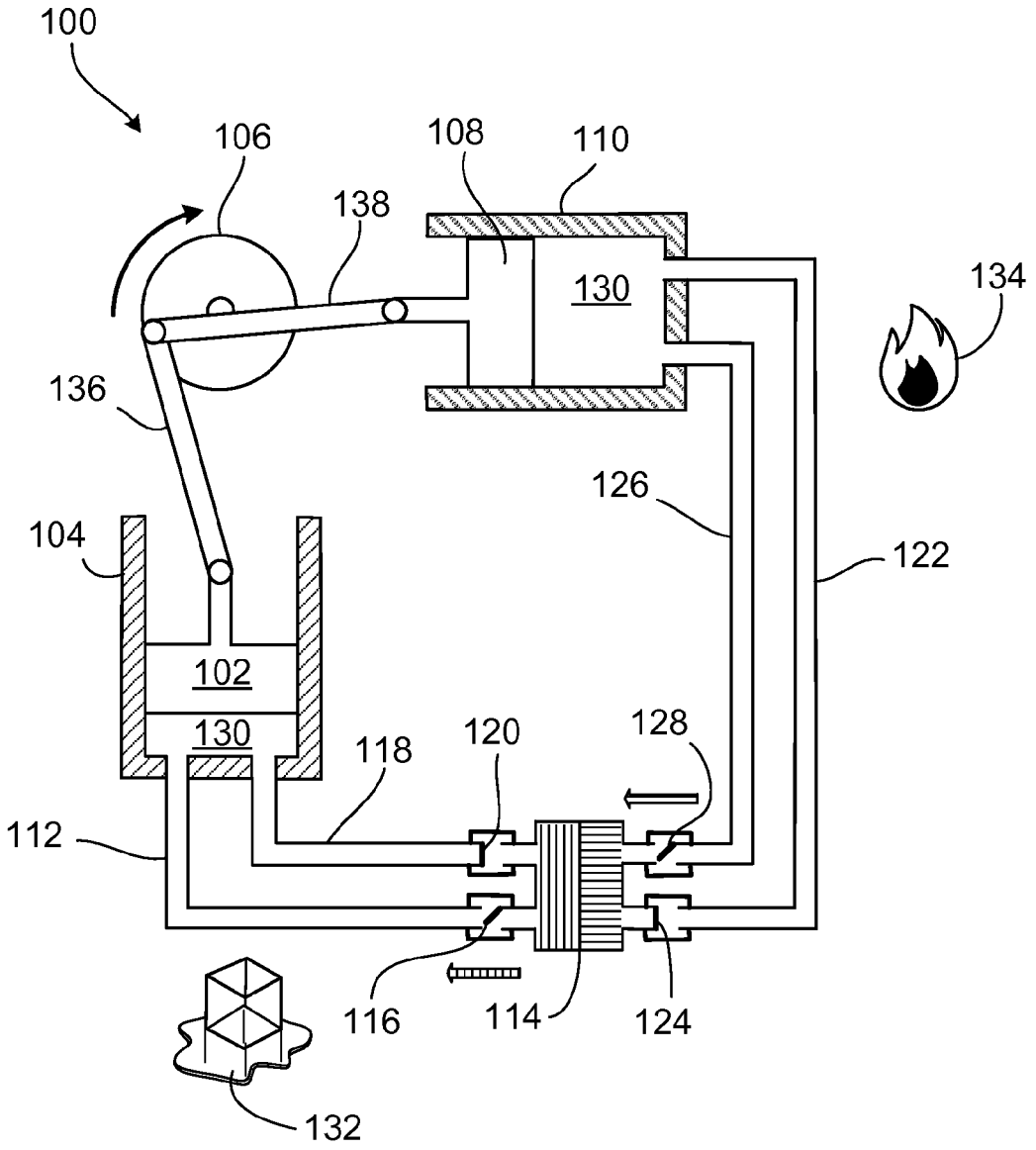
FIG. 1A shows a valved Stirling engine.

FIG. 1A shows a valved Stirling engine 100, in a configuration sometimes known as an Alpha configuration. In some implementations, the engine 100 has a first piston 102 and a second piston 108. The first piston 102 is contained in a cold cylinder 104, such that the first piston 102 interacts with a flywheel 106. In some implementations, the first piston 102 is attached to the flywheel 106, for example, by a first connecting rod 136. The first piston 102 is moveable, for example, longitudinally movable, inside the cold cylinder 104. The movement can affect a working gas 130. For example, the movement may cause compression of the working gas 130. This movement also affects the flywheel 106. The flywheel 106 is moveable, for example rotationally moveable, such that the movement affects the first piston 102. The working gas 130 also affects the first piston 102. For example, expansion of the working gas 130 can cause the first piston 102 to move.

In some implementations, the second piston 108 is contained in a hot cylinder 110. The second piston 108 interacts with the flywheel 106. In some implementations, the second piston 108 is attached to the flywheel 106, for example, by a second connecting rod 138. The second piston 108 is moveable, for example, longitudinally movable, inside the hot cylinder 110. The movement can affect the working gas 130. For example, the movement may cause compression of the working gas 130. This movement also affects the flywheel 106. As described above, the flywheel 106 is moveable, for example rotationally movable, such that the movement affects the second piston 108. The working gas 130 also affects the second piston 108. For example, expansion of the working gas 130 can cause the second piston 108 to move.

In some implementations, multiple flywheels are used. In some implementations, multiple flywheels are bound by a belt.

In some implementations, as shown, the first cylinder 104 and the second cylinder 110 are positioned at an approximately ninety degree angle to one another.

In some implementations, the first piston 102 or the second piston 108 or both can be partially contained in their respective cylinders 104, 110. For example, the top of the first piston 102 can extend above the top of the cold cylinder 104, while the bottom of the first piston 102 remains below the top of the cold cylinder 104.

In some implementations a cooling tube 112 is placed between the cold cylinder 104 and a regenerator 114 and defines a path in which the working gas 130 can travel between the cold cylinder 104 and the regenerator 114. The cooling tube 112 removes heat from the working gas 130. The cooling tube 112 contains a first unidirectional valve 116 that directs a flow of working gas 130 through the cooling tube 112 towards the cold cylinder 104. The first unidirectional valve 116 resists the flow of working gas 130 towards the regenerator 114. As shown in the figure, the first unidirectional valve 116 is open, allowing the working gas 130 to flow from the regenerator 114 to the cold cylinder 104 by way of the cooling tube 112.

One problem with existing Stirling engines is the energy loss across the regenerator. One cause of the energy loss is the temperature difference across the regenerator. Including bypass tubes to direct the working gas can reduce the loss of energy.

In some implementations, a cold bypass tube 118 is placed between the cold cylinder 104 and the regenerator 114 and defines a path in which the working gas 130 can travel between the cold cylinder 104 and the regenerator 114. The cold bypass tube 118 contains a second unidirectional valve 120 that directs a flow of working gas 130 through the cold bypass tube 118 towards the regenerator 114. The second unidirectional valve 120 resists the flow of working gas 130 towards the cold cylinder 104. As shown in the figure, the second unidirectional valve 120 is closed, prohibiting the working gas 130 from flowing from the regenerator 114 to the cold cylinder 104 by way of the cold bypass tube 118.

In some implementations a heating tube 122 is placed between the hot cylinder 110 and the regenerator 114 and defines a path in which the working gas 130 can travel between the hot cylinder 110 and the regenerator 114. The heating tube 122 heats the working gas 130. The heating tube 122 contains a third unidirectional valve 124 that directs a flow of working gas 130 through the heating tube 122 towards the hot cylinder 110. The third unidirectional valve 124 resists the flow of working gas 130 towards the regenerator 114. As shown in the figure, the third unidirectional valve 124 is closed, prohibiting the working gas 130 from flowing from the hot cylinder 110 to the regenerator 114 by way of the heating tube 122.

In some implementations, a hot bypass tube 126 is placed between the hot cylinder 110 and the regenerator 114 and defines a path in which the working gas 130 can travel between the hot cylinder 110 and the regenerator 114. The hot bypass tube 126 contains a fourth unidirectional valve 128 that directs a flow of the working gas 130 through the hot bypass tube 126 towards the regenerator 114. The fourth unidirectional valve 128 resists the flow of working gas 130 towards the hot cylinder 110. As shown in the figure, the fourth unidirectional valve 128 is open, allowing the working gas 130 to flow from the hot cylinder 110 to the regenerator 114 by way of the hot bypass tube 126.

As shown in the figure, the valved Stirling engine 100 is in a phase of its operation such that the working gas 130 has expanded in the hot cylinder 110, causing, by way of the second connecting rod 138, the second piston 108 to move the flywheel 106 rotationally. The working gas 130 is beginning to expand in the cold cylinder 104, causing, by way of the first connecting rod 136, the first piston 102 to move the flywheel 106 rotationally.

In some implementations a heat source 134 transfers heat to the heating tube 122. In some implementations the cooling tube 112 transfers heat to a heat sink 132.

In some implementations the regenerator 114 contains wire mesh.

In some implementations, the working gas 130 is a monatomic gas, for example, helium. One characteristic of using a monatomic gas is the increased adiabatic cooling and heating as compared to other gases. The result is a reduced temperature differential across the regenerator, thus reducing the heat loss and increasing efficiency.

Other configurations of the engine with multiple parallel cooling tubes or heating tubes or both are within the scope of the invention. For example, the cooling tube 112 can be replaced with multiple parallel cooling tubes, or the heating tube 122 can be replaced with multiple parallel heating tubes, or both.

Other configurations of the engine with multiple parallel regenerators are within the scope of the invention. For example, the regenerator 114 can be replaced by multiple parallel regenerators, each with its own set of parallel cooling tubes, heating tubes, cold bypass tubes, hot bypass tubes, and unidirectional valves.

Figure 1B:
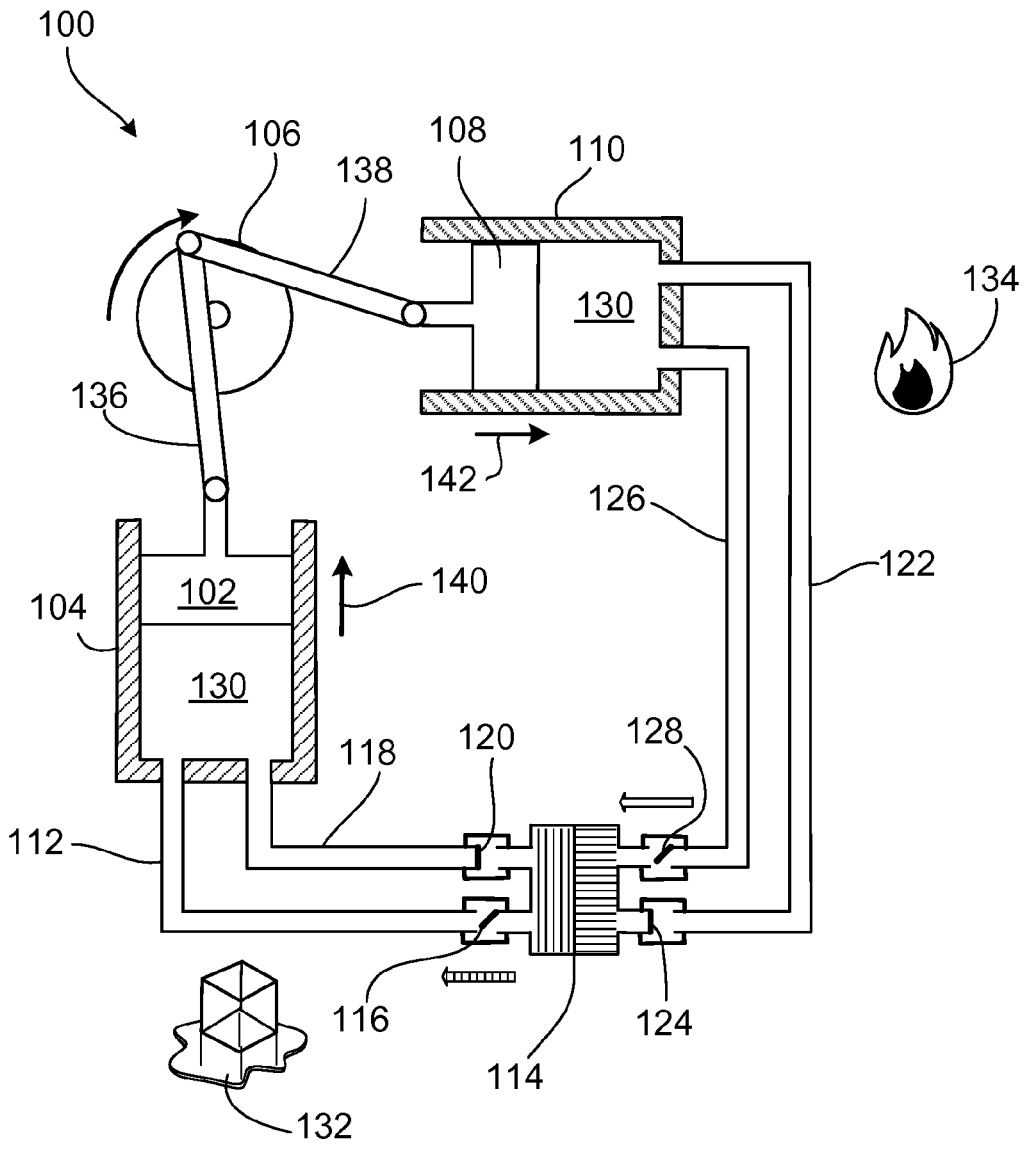
FIG. 1B shows an implementation of the valved Stirling engine from FIG. 1A in a phase of its operational cycle subsequent to the phase shown in FIG. 1A.

FIG. 1B shows an implementation of the valved Stirling engine 100 from FIG. 1A in a phase of its operational cycle subsequent to the phase shown in FIG. 1A. The flywheel 106 has rotated, causing the second connecting rod 138 to move the second piston 108 in a direction 142 parallel to the longitudinal axis of the hot cylinder 110. The second piston 108 is beginning to compress the working gas 130. The third unidirectional valve 124 is closed and resists the flow of the working gas 130 towards the regenerator 114 through the heating tube 122. The fourth unidirectional valve 128 is opened, allowing the working gas 130 to flow from the hot cylinder 110 to the regenerator 114 by way of the hot bypass tube 126. Because the adiabatically cooled working gas 130 flows through the hot bypass tube 126, the adiabatically cooled working gas 130 does not flow through the heating tube 122 and thus is not heated in the heating tube 122 by the heat source 134 on the way to the regenerator 114.

As shown in the figure, the first unidirectional valve 116 is open, allowing the working gas 130 to flow from the regenerator 114 to the cold cylinder 104 by way of the cooling tube 112. The working gas 130 is cooled by flowing through the cooling tube 112 past the heat sink 132 on the way to the cold cylinder 104. The second unidirectional valve 120 is closed, resisting the flow of the working gas 130 towards the cold cylinder 104 from the regenerator 114 through the cold bypass tube 118. The working gas 130 expands in the cold cylinder 104, moving the first piston 102 in a direction 140 parallel to the longitudinal axis of the cold cylinder 104. The first piston 102 causes the first connecting rod 136 to move the flywheel 106 rotationally.

Figure 1C:
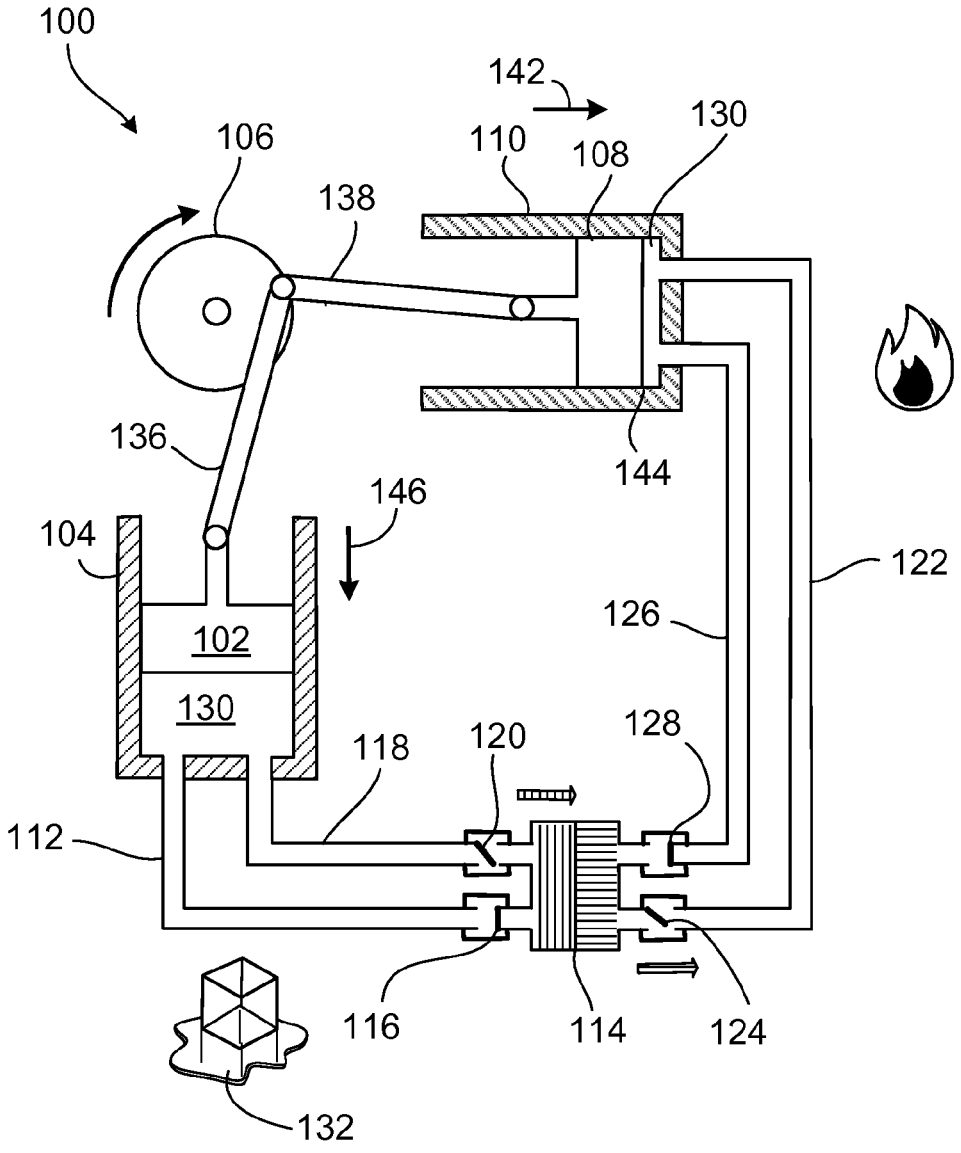
FIG. 1C shows an implementation of the valved Stirling engine from FIG. 1B in a phase of its operational cycle subsequent to the phase shown in FIG. 1B.

FIG. 1C shows an implementation of the valved Stirling engine 100 from FIG. 1B in a phase of its operational cycle subsequent to the phase shown in FIG. 1B. The flywheel 106 has rotated causing the first connecting rod 136 to move the first piston 102 in a direction 146 parallel to the longitudinal axis of the cold cylinder 104. The first piston 102 compresses the working gas 130, which is thus adiabatically heated. The first unidirectional valve 116 is closed and resists the flow of the working gas 130 through the cooling tube 112 towards the regenerator 114. The second unidirectional valve 120 is opened, allowing the working gas 130 to flow from the cold cylinder 104 to the regenerator 114 by way of the cold bypass tube 118. Because the working gas 130 flows through the cold bypass tube 118, the working gas 130 does not flow through the cooling tube 112 and thus the working gas 130, having been adiabatically heated, is not cooled in the cooling tube 112 by the heat sink 132 on the way to the regenerator 114.

As shown in the figure, the third unidirectional valve 124 is opened, allowing the working gas 130 to flow through the heating tube 122 from the regenerator 114 towards the hot cylinder 110. The fourth unidirectional valve 128 is closed and resists the flow of the working gas 130 from the regenerator 114 towards the hot cylinder 110 by way of the hot bypass tube 126.

The flywheel 106 has rotated causing the second connecting rod 138 to move the second piston 108 in a direction 142 parallel to the longitudinal axis of the hot cylinder 110. As shown in the figure, the second piston 108 is near a position 144 of minimum volume of the working gas 130 in the hot cylinder 110.

Figure 1D:
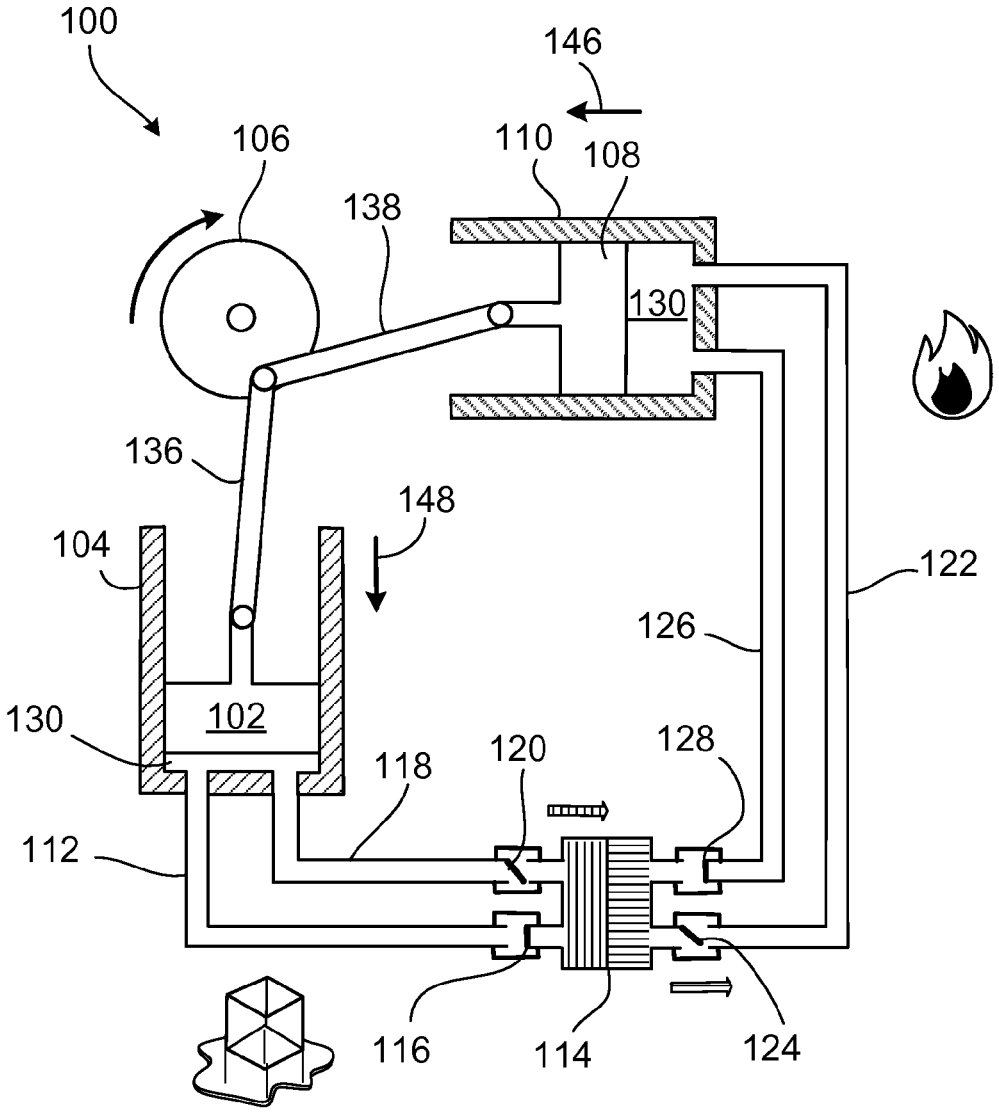
FIG. 1D shows an implementation of the valved Stirling engine from FIG. 1C in a phase of its operational cycle subsequent to the phase shown in FIG. 1C.

FIG. 1D shows an implementation of the valved Stirling engine 100 from FIG. 1C in a phase of its operational cycle subsequent to the phase shown in FIG. 1C. The fourth unidirectional valve 128 is closed and resists the flow of the working gas 130 from the regenerator 114 towards the hot cylinder 110 by way of the hot bypass tube 126. The third unidirectional valve 124 is opened, allowing the working gas 130 to flow by way of the heating tube 122 from the regenerator 114 towards the hot cylinder 110. The heated working gas 130 expands in the hot cylinder 110 moving the second piston 108 in a direction 146 parallel to the longitudinal axis of the hot cylinder 110. The second piston 108 causes the second connecting rod 138 to move the flywheel 106 rotationally.

As shown in the figure, the flywheel 106 has rotated causing the first connecting rod 136 to move the first piston 102 in a direction 148 parallel to the longitudinal axis of the cold cylinder 104. The first piston 102 compresses the working gas 130, which is thus adiabatically heated. The first unidirectional valve 116 is closed and resists the flow of the working gas 130 through the cooling tube 112 towards the regenerator 114. The second unidirectional valve 120 is opened, allowing the working gas 130, having been adiabatically heated, to flow from the cold cylinder 104 to the regenerator 114 by way of the cold bypass tube 118 without being cooled in the cooling tube 112.

As explained above, one problem with existing Stirling engines is the energy loss across the regenerator. Bypass tubes and unidirectional valves can be configured such that the regenerator can be eliminated, reducing the loss of energy, for example, by eliminating the dead volume of working gas in the regenerator. In this way, the compression ratios can be adjusted such that the adiabatic heated temperature of the working gas from the cold cylinder is the same or higher than the adiabatic cooled temperature of the working gas from the hot cylinder, thus eliminating the need for a regenerator.

Figure 2:
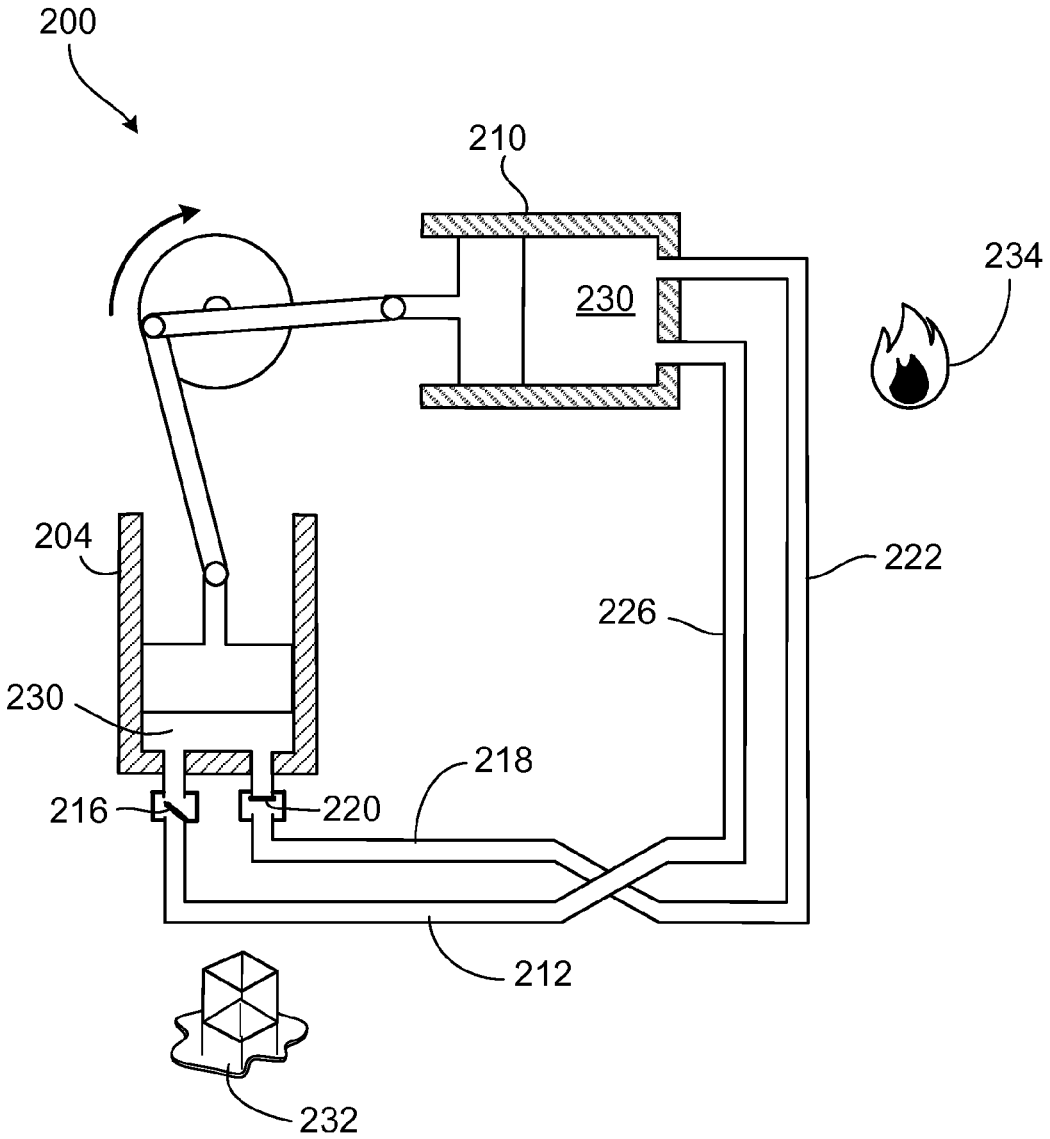
FIG. 2 shows a valved Stirling engine without a regenerator.

FIG. 2 shows a valved Stirling engine 200 without a regenerator. In some implementations, the engine 200 has a heating tube 222 placed between a hot cylinder 210 and a cold bypass tube 218 and defines a path in which a working gas 230 can travel between the cold bypass tube 218 and the hot cylinder 210. In some implementations, a heat source 234 transfers heat to the heating tube 222. The cold bypass tube 218 is placed between the heating tube 222 and a cold cylinder 204. In some implementations, a cooling tube 212 is placed between the cold cylinder 204 and a hot bypass tube 226 and defines a path in which the working gas 230 can travel between the hot bypass tube 226 and the cold cylinder 204. In some implementations, the cooling tube transfers heat to a heat sink 232.

In some implementations, the cooling tube 212 contains a first unidirectional valve 216 that directs a flow of working gas 130 from the hot bypass tube 226 towards the cold cylinder 204. The first unidirectional valve 216 resists the flow of working gas from the cold cylinder 204 towards the hot bypass tube 226. As shown in the figure, the first unidirectional valve 216 is open, allowing the working gas 230 to flow from the hot bypass tube 226 to the cold cylinder 204 through the cooling tube 212. Because the working gas 230 flows through the hot bypass tube 226, the working gas 230 does not flow through the heating tube 222 and thus is not heated in the heating tube 222 by the heat source 234 on the way to the cold cylinder 204.

In some implementations, the cold bypass tube 218 contains a second unidirectional valve 220 that directs a flow of working gas 230 from the cold cylinder 204 towards the heating tube 222. As shown in the figure, the second unidirectional valve 220 is closed and resists the flow of working gas 230 from the heating tube 222 towards the cold cylinder 204. Because the working gas 230 does not flows through the cold bypass tube 218, the working gas 230 flows through cooling tube 212 and thus is cooled in the cooling tube 212 by the heat sink 232 on the way to the cold cylinder 204.

One advantage of having the unidirectional valves contained in the cooling tube and the cold bypass tube is to reduce the heating of the valves. Heating the valves can increase the chance of valve failure. Moreover, the working gas flowing towards the valves is at least adiabatically cooled from its hottest temperature, also extending the operational life of the valves.

The operation of the pistons and flywheel is similar to the operation of the pistons and flywheel as shown in FIGS. 1A-D and their corresponding descriptions above.

In some implementations, a hot piston and a cold piston are placed in a single cylinder. This configuration is sometimes called a Beta configuration.

Figure 3A:
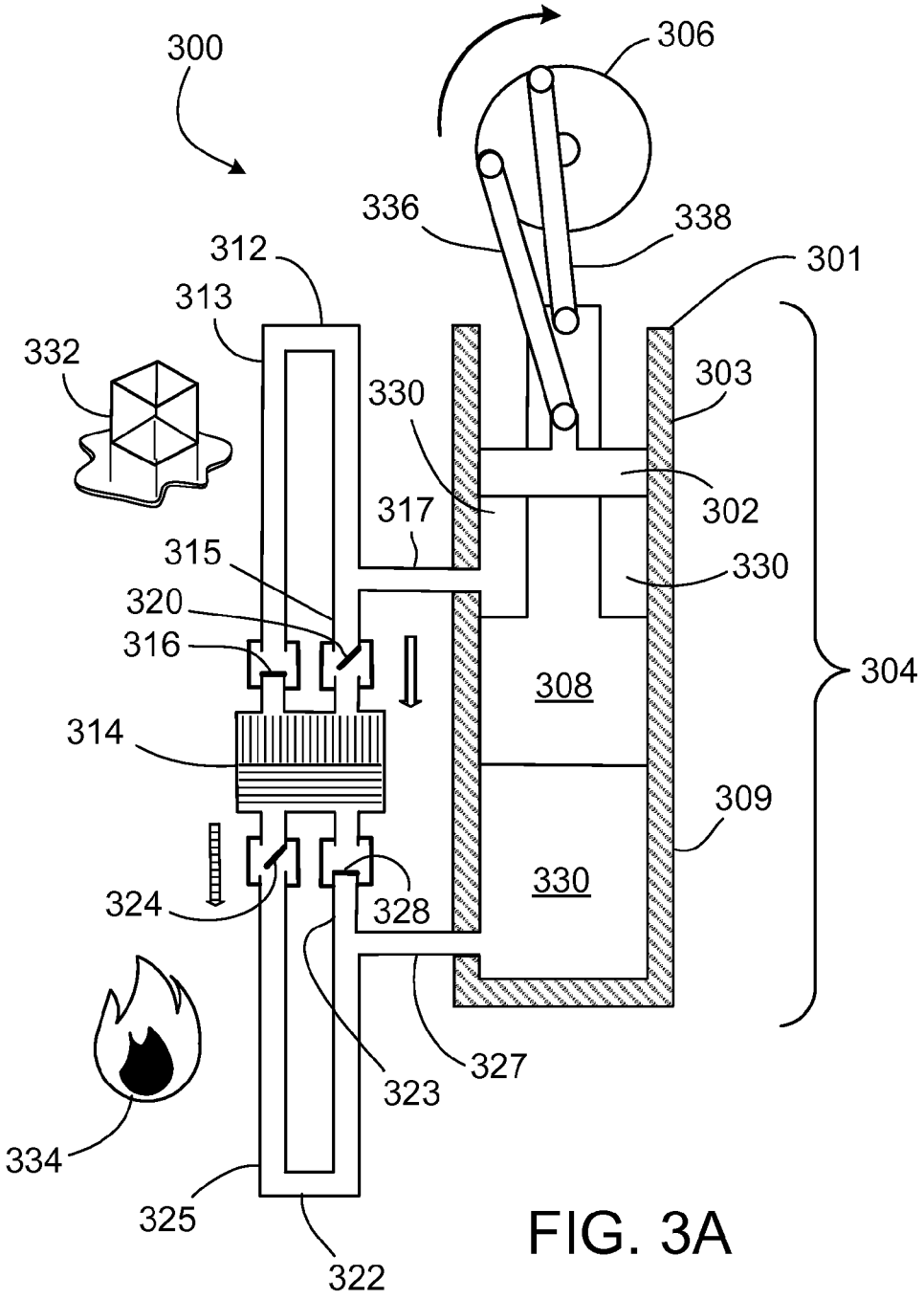
FIG. 3A shows a valved Stirling engine with a single cylinder.

FIG. 3A shows a valved Stirling engine 300 with a single cylinder 304. In some implementations, the engine 300 has a first piston 302 and a second piston 308, such that both the first piston 302 and the second piston 308 are contained in the cylinder 304. The second piston 308 is sometimes called a displacer piston. The first piston 302 is contained in a cold portion 303 of the cylinder 304, such that the first piston 302 interacts with a flywheel 306. In some implementations, the first piston 302 is attached to the flywheel 306, for example, by a first connecting rod 336. The first piston 302 is moveable, for example, longitudinally movable, inside the cold portion 303 of the cylinder 304. The movement can affect a working gas 330. For example, the movement may cause compression of the working gas 330. This movement also affects the flywheel 306. The flywheel 306 is moveable, for example rotationally moveable, such that the movement affects the first piston 302. The working gas 330 also affects the first piston 302. For example, expansion of the working gas 330 can cause the first piston 302 to move.

In some implementations, a compression ratio is defined by the maximum volume of the working gas 330 when the first piston 302 is closest to a position 301 of the cylinder 304, divided by the minimum volume of the working gas 330 when the first piston 302 is farthest from the position 301 of the cylinder 304.

In some implementations, the second piston 308 is contained in a hot portion 309 of the cylinder 304. The second piston 308 interacts with the flywheel 306. In some implementations, the second piston 308 is attached to the flywheel 306, for example, by a second connecting rod 338. The second piston 308 is moveable, for example, longitudinally movable, inside the hot portion 309 of the cylinder 304. The movement can affect the working gas 330. For example, the movement may cause the working gas 330 to flow out of the hot portion 309 of the cylinder 304 or the cold portion 303 of the cylinder 304. As explained above, the flywheel 306 is moveable, for example rotationally movable, such that the movement affects the second piston 308.

In other implementations, the engine 300 can use multiple flywheels as shown and discussed above.

In some implementations, the first piston 302 can be partially contained in the cylinder 304. For example, the top of the first piston 302 can extend above the top of the cylinder 304, while the bottom of the first piston 302 remains below the top of the cylinder 304.

In some implementations a cooling u-tube 312 is placed between the cold portion 303 of the cylinder 304 and a regenerator 314. In some implementations, the cooling u-tube 312 contains a cooling tube portion 313, a cold bypass portion 315. In some implementations, the cooling u-tube 312 contains a cooling u-tube connector 317. The cooling u-tube connector 317 connects the cold portion 303 of the cylinder 304 with the cooling u-tube 312 and is placed between the cooling tube portion 313 of the cooling u-tube 312 and the cold bypass portion 315 of the cooling u-tube 312. The cooling u-tube 312 defines a path in which the working gas 330 can travel between the cold portion 303 of the cylinder 304 and the regenerator 314. The cooling tube portion 313 of the cooling u-tube 312 removes heat from the working gas 330. The cooling tube portion 313 of the cooling u-tube 312 contains a first unidirectional valve 316 that directs a flow of working gas 330 through the cooling u-tube 312 towards the cold portion 303 of the cylinder 304. The first unidirectional valve 316 resists the flow of working gas 330 towards the regenerator 314. As shown in the figure, the first unidirectional valve 316 is closed, prohibiting the working gas 330 from flowing from the cold portion 303 of the cylinder 304 to the regenerator 314 by way of the cooling tube portion 313 of the cooling u-tube 312. As a result, the working gas 330 instead flows towards the regenerator 314 by way of the cold bypass portion 315 of the cooling u-tube 312. This has the effect of not cooling the adiabatically heated working gas 330 on the way to the regenerator 314, thus reducing energy loss across the regenerator 314.

In some implementations, the cold bypass portion 315 of the cooling u-tube 312 contains a second unidirectional valve 320 that directs a flow of working gas 330 through the cold bypass portion 315 of the cooling u-tube 312 towards the regenerator 314. The second unidirectional valve 320 resists the flow of working gas 330 towards the cold portion 303 of the cylinder 304. As shown in the figure, the second unidirectional valve 320 is open, allowing the working gas 330 to flow from the cold portion 303 of the cylinder 304 towards the regenerator 314 by way of the cold bypass portion 315 of the cooling u-tube 312. As a result, the working gas 330 does not flow by way of the cooling tube portion 313 of the cooling u-tube 312 on the way to the regenerator 314. This has the effect of not cooling the adiabatically heated working gas 330 on the way to the regenerator 314, thus reducing energy loss across the regenerator 314.

In some implementations a heating u-tube 322 is placed between the hot portion 309 of the cylinder 304 and the regenerator 314. In some implementations, the heating u-tube 322 contains a heating tube portion 325, a hot bypass portion 323. In some implementations, the heating u-tube 322 contains a heating u-tube connector 327. The heating u-tube connector 327 connects the hot portion 309 of the cylinder 304 with the heating u-tube 322 and is placed between the heating tube portion 325 of the heating u-tube 322 and the hot bypass portion 323 of the heating u-tube 322. The heating u-tube 322 defines a path in which the working gas 330 can travel between the hot portion 309 of the cylinder 304 and the regenerator 314. The heating tube portion 325 of the heating u-tube 322 heats the working gas 330. The heating tube portion 325 of the heating u-tube 322 contains a third unidirectional valve 324 that directs a flow of working gas 330 through the heating u-tube 322 towards the hot portion 309 of the cylinder 304. The third unidirectional valve 324 resists the flow of working gas 330 towards the regenerator 314. As shown in the figure, the third unidirectional valve 324 is open, allowing the working gas 330 to flow from the regenerator 314 towards the hot portion 309 of the cylinder 304 by way of the heating tube portion 325 of the heating u-tube 322. This has the effect of conserving energy because, as shown above, the working gas 330 is not cooled on the way to the regenerator 314.

In some implementations, the hot bypass portion 323 of the heating u-tube 322 contains a fourth unidirectional valve 328 that directs a flow of working gas 330 through the hot bypass portion 323 of the heating u-tube 322 towards the regenerator 314. The fourth unidirectional valve 328 resists the flow of working gas 330 towards the hot portion 309 of the cylinder 304. As shown in the figure, the fourth unidirectional valve 380 is closed, prohibiting the working gas 330 from flowing from the regenerator 314 towards the hot portion 309 of the cylinder 304 by way of the hot bypass portion 323 of the heating u-tube 322. As a result, the working gas 330 does not flow from the regenerator 314 towards the hot portion 309 of the cylinder 304 by way of the hot bypass portion 323 of the heating u-tube 322. This has the effect of heating the working gas 330 in the heating tube portion 325 of the heating u-tube 322 on the way to the hot portion 309 of the cylinder 304. Thus the working gas 330 in the hot portion 309 of the cylinder 304 expands and moves the second piston 308 longitudinally.

In some implementations, tubes other than the u-tubes shown in FIG. 3A can be used. For example, tubes having a spiral shape could be used in place of the u-tubes. In some implementations, multiple parallel tubes could be used. For example, the cooling u-tube 312 could take the form of multiple parallel cooling u-tubes, and/or the heating u-tube 322 could take the form of multiple parallel heating u-tubes. In this example, multiple regenerators 314 arranged in parallel may be used, and multiple valves arranged in parallel may be used.

As shown in the figure, the valved Stirling engine 300 is in a phase of its operation such that the working gas 330 is expanding in the hot portion 309 of the cylinder 304. The expansion of the working gas 330 moves the first piston 302, causing the first connecting rod 336 to move the flywheel 306 rotationally. The flywheel 306 has caused the second piston 308 to move closer to the position 301 of the cylinder 304, such that the second piston 308 is near its shortest distance from the position 301. The movement of the second piston 308 causes the working gas 330 to flow out of the cold portion 303 of the cylinder 304.

In some implementations a heat source 334 transfers heat to the heating tube portion 325 of the heating u-tube 322. In some implementations, the cooling tube portion 313 of the cooling u-tube 312 transfers heat to a heat sink 332.

In some implementations the regenerator 314 contains wire mesh.

Figure 3B:
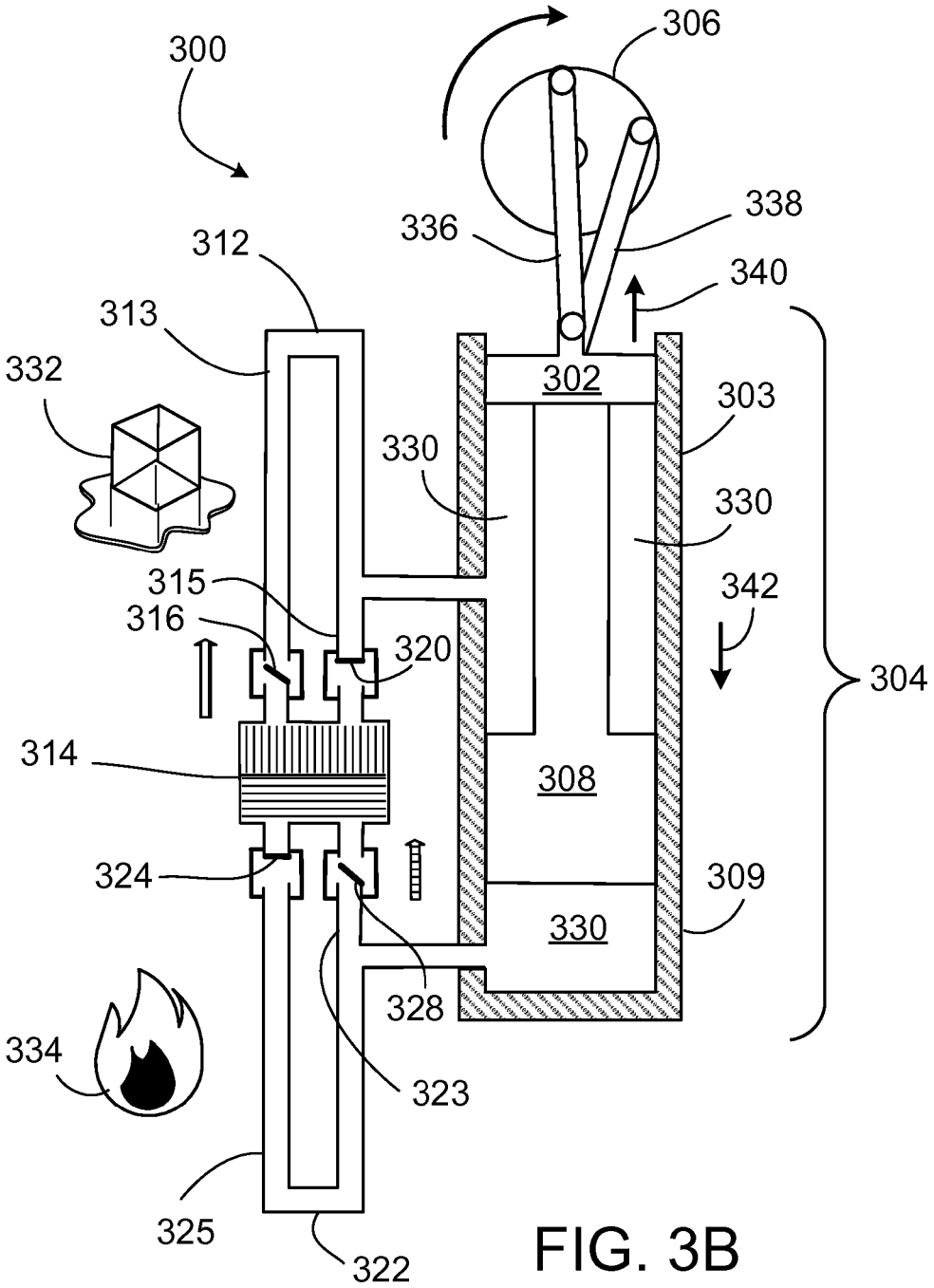
FIG. 3B shows an implementation of the valved Stirling engine from FIG. 3A in a phase of its operational cycle subsequent to the phase shown in FIG. 3A.

FIG. 3B shows an implementation of the valved Stirling engine 300 from FIG. 3A in a phase of its operational cycle subsequent to the phase shown in FIG. 3A. The flywheel 306 has rotated, causing the second connecting rod 338 to move the second piston 308 in a direction 342 parallel to the longitudinal axis of the cylinder 304. The second piston 308 causes the working gas 330 to flow out of the hot portion 309 of the cylinder 304. The third unidirectional valve 324 is closed and resists the flow of the working gas 330 towards the regenerator 314 through the heating tube portion 325 of the heating u-tube 322. The fourth unidirectional valve 328 is opened, allowing the working gas 330 to flow from the hot portion 309 of the cylinder 304 to the regenerator 314 by way of the hot bypass portion 323 of the heating u-tube 322. Because the working gas 330 flows through the hot bypass portion 323 of the heating u-tube 322, the adiabatically cooled working gas 330 does not flow through the heating tube portion 325 of the heating u-tube 322 and thus is not heated in the heating tube portion 325 of the heating u-tube 322 by the heat source 334 on the way to the regenerator 314. Instead, the working gas 330 flows through the hot bypass portion 323 of the heating u-tube 322 towards the regenerator 314. This has the effect of not heating the working gas 330 on the way to the regenerator 314, thus reducing the energy loss across the regenerator 314.

As shown in the figure, the first unidirectional valve 316 is open, allowing the working gas 330 to flow from the regenerator 314 to the cold portion 303 of the cylinder 304 by way of the cooling tube portion 313 of the cooling u-tube 312. The working gas 330 is cooled by flowing through the cooling tube portion 313 of the cooling u-tube 312 past the heat sink 332 on the way to the cold portion 303 of the cylinder 304. The second unidirectional valve 320 is closed, resisting the flow of the working gas 330 towards the cold portion 303 of the cylinder 304 from the regenerator 314 through the cold bypass portion 315 of the cooling u-tube 312. This has the effect of conserving energy because, as shown above, the working gas 330 is not heated on the way to the regenerator 314. The cooled working gas 330 will be cooled in the next phase of operation of the engine 300, as explained below. The first piston 302 causes the first connecting rod 336 to move the flywheel 306 rotationally.

Figure 3C:
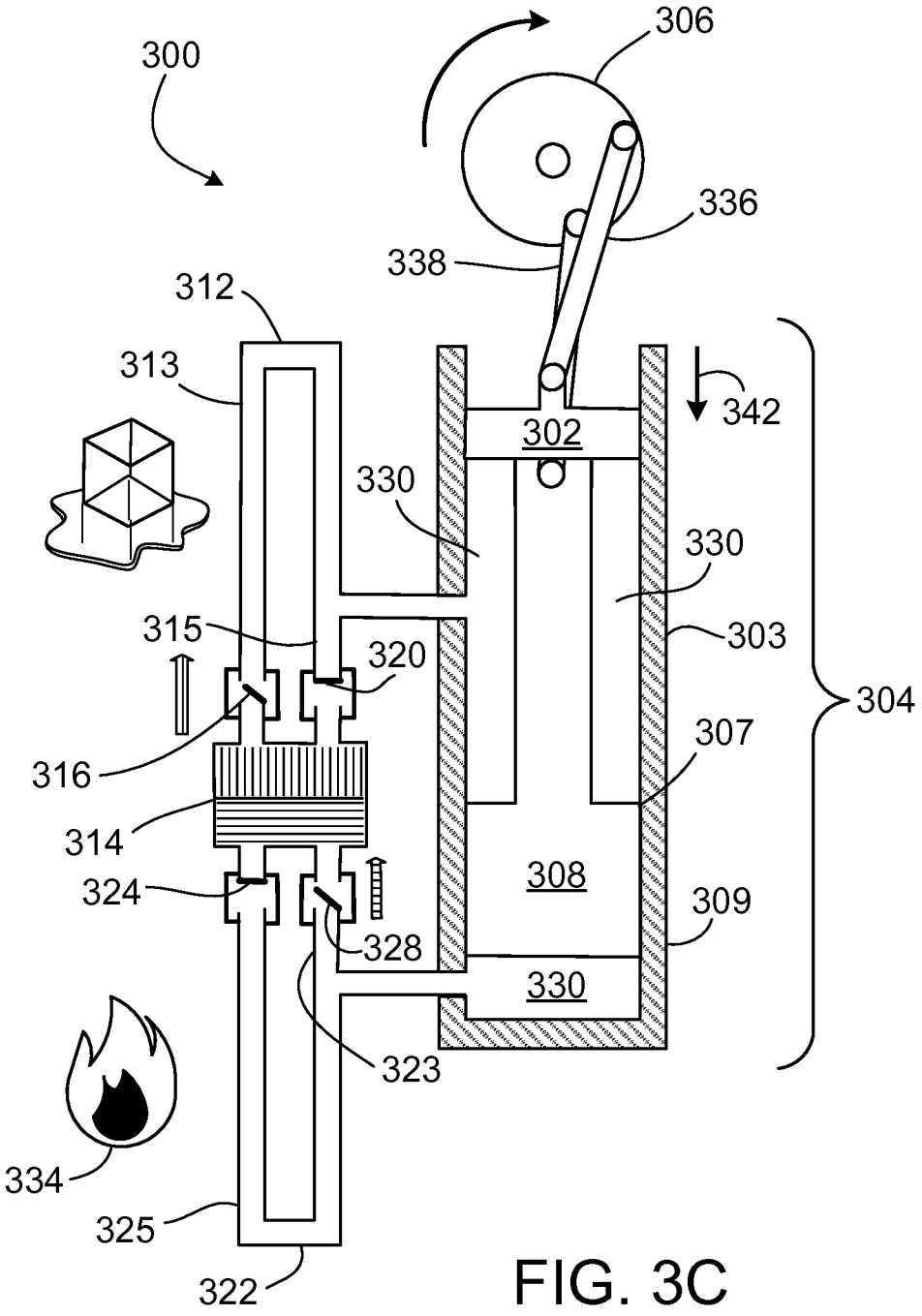
FIG. 3C shows an implementation of the valved Stirling engine from FIG. 3B in a phase of its operational cycle subsequent to the phase shown in FIG. 3B.

FIG. 3C shows an implementation of the valved Stirling engine 300 from FIG. 3B in a phase of its operational cycle subsequent to the phase shown in FIG. 3B. The flywheel 306 has rotated causing the first connecting rod 336 to move the first piston 302 and the second piston 308 in a direction 342 parallel to the longitudinal axis of the cylinder 304. The movement of the first piston 302 compresses the working gas 330. The movement of the second piston 308 causes the working gas 330 in the hot portion 309 of the cylinder 304 to flow towards the regenerator 314 and subsequently towards the cold portion 303 of the cylinder 304 by way of the cooling tube portion 313 of the cooling u-tube 312. The working gas 330 is thus cooled in the cooling tube portion 313 of the cooling u-tube 312 on the way to the cold portion 303 of the cylinder 304. The first unidirectional valve 316 is opened, allowing the working gas 330 to flow from the regenerator 314 by way of the cooling tube portion 313 of the cooling u-tube 312 towards the cold portion 303 of the cylinder 304. The second unidirectional valve 320 is closed and resists the flow of working gas 330 from the regenerator 314 towards the cold portion 303 of the cylinder 304 by way of the cold bypass portion 315 of the cooling u-tube 312. This has the effect of conserving energy because, as shown below, the adiabatically cooled working gas 330 is not heated on the way to the regenerator 314.

As shown in the figure, the third unidirectional valve 324 is closed and resists the flow of working gas 330 from the heating tube portion 325 of the heating u-tube 322 towards the regenerator 314. The fourth unidirectional valve 328 is opened, allowing the working gas 330 to flow from the hot portion 309 of the cylinder 304 towards the regenerator 314 by way of the hot bypass portion 323 of the heating u-tube 322. Because the working gas 330 flows through the hot bypass portion 323 of the heating u-tube 322, the working gas 330 does not flow through the heating tube portion 325 of the heating u-tube 322 and thus is not heated in the heating tube portion 325 of the heating u-tube 322 by the heat source 334 on the way to the regenerator 314. Thus, energy is conserved because the working gas 330 that is about to be cooled in the cooling tube portion 313 of the cooling u-tube 312 is not heated on the way to the regenerator 314, thus reducing the energy loss across the regenerator 314.

Figure 3D:
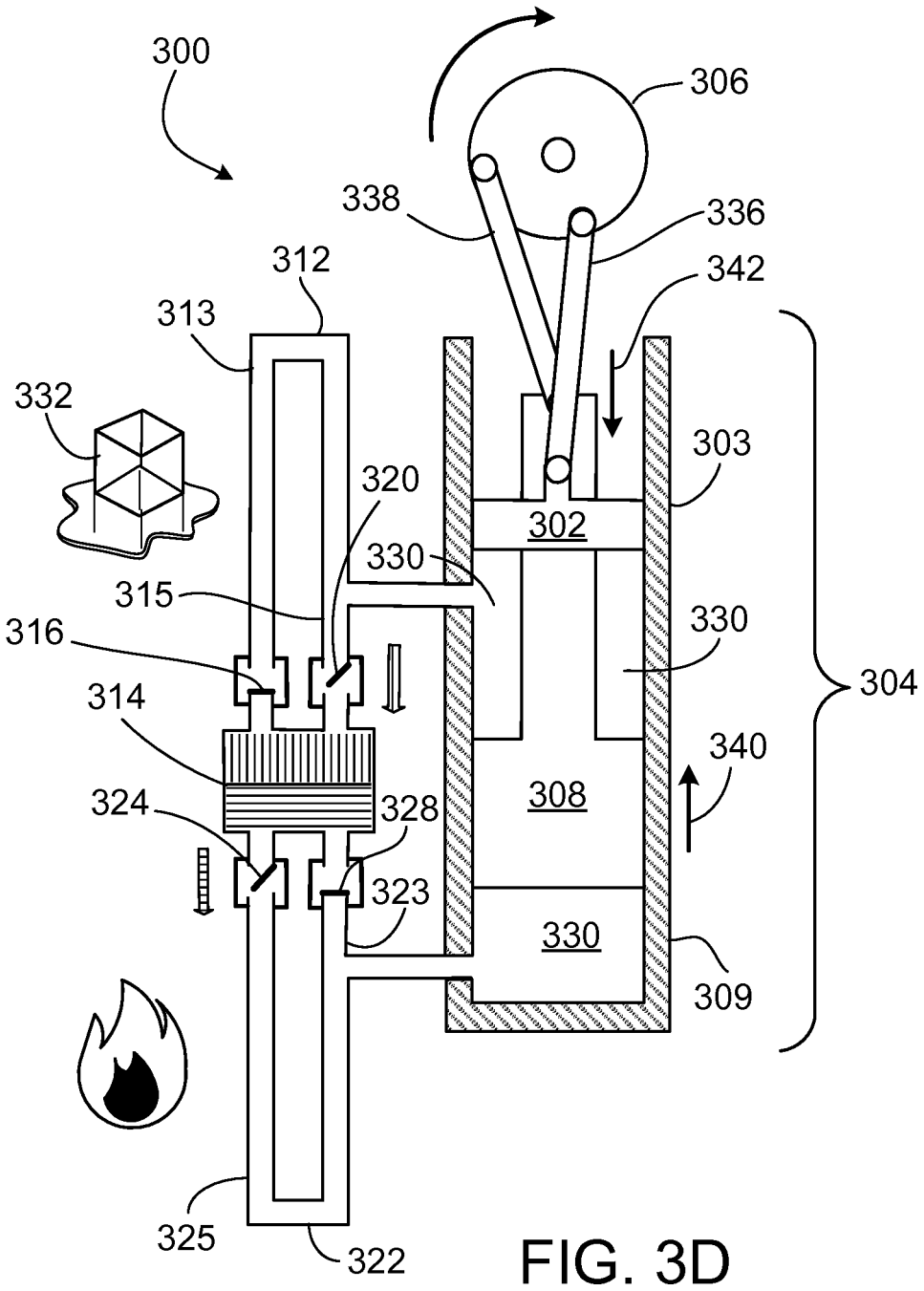
FIG. 3D shows an implementation of the valved Stirling engine from FIG. 3C in a phase of its operational cycle subsequent to the phase shown in FIG. 3C.

FIG. 3D shows an implementation of the valved Stirling engine 300 from FIG. 3C in a phase of its operational cycle subsequent to the phase shown in FIG. 3C. The fourth unidirectional valve 328 is closed and resists the flow of the working gas 330 from the regenerator 314 towards the hot portion 309 of the cylinder 304 by way of the hot bypass portion 323 of the heating u-tube 322. The third unidirectional valve 224 is opened, allowing the working gas 330 to flow by way of the heating tube portion 325 of the heating u-tube 322 from the regenerator 314 towards the hot portion 309 of the cylinder 304. As a result, the working gas 330 does not flow from the regenerator 314 towards the hot portion 309 of the cylinder 304 by way of the hot bypass portion 323 of the heating u-tube 322. This has the effect of heating the working gas 330 in the heating tube portion 325 of the heating u-tube 322 on the way to the hot portion 309 of the cylinder 304. Thus, the heated working gas 330 expands in the hot portion 309 of the cylinder 304 moving the second piston 308 in a direction 340 parallel to the longitudinal axis of the cylinder 304. The second piston 308 causes the second connecting rod 338 to move the flywheel 306 rotationally.

As shown in the figure, the flywheel 306 has rotated causing the first connecting rod 336 to move the first piston 302 in a direction 342 parallel to the longitudinal axis of the cylinder 304. The rotation of the flywheel 306 has also caused the second connecting rod 338 to move the second piston 308 in a direction 340 parallel to the longitudinal axis of the cylinder 304. The movement direction 342 of the first piston 302 causes the first piston 302 to compress the working gas 330 within the cold portion 303 of the cylinder 304. The movement of the second piston 308 causes the working gas 330 in the cold portion 303 of the cylinder 304 to flow towards the regenerator 314 and subsequently towards the hot portion 309 of the cylinder 304 by way of the heating tube portion 325 of the heating u-tube 322. The working gas 330 is thus heated in the heating tube portion 325 of the heating u-tube 322 on the way to the hot portion 309 of the cylinder 304. The first unidirectional valve 316 is closed and resists the flow of the working gas 330 through the cooling tube portion 313 of the cooling u-tube 312 towards the regenerator 314. The second unidirectional valve 320 is opened, allowing the working gas 330 to flow from the cold portion 303 of the cylinder 304 to the regenerator 314 by way of the cold bypass portion 315 of the cooling u-tube 312 without being cooled in the cooling tube portion 313. This has the effect of conserving energy because the working gas 330 entering the heating tube portion 325 of the heating u-tube 322 from the regenerator 314 is at a higher temperature than it would be without the bypass tubes and unidirectional valves as shown above.

In some implementations, the compression ratio discussed above can be increased, for example, by adjusting the shapes of the pistons 302, 308 or the cylinder 304 or both. For example, the volume of the cylinder 304 can be changed. An increased compression ratio increases the adiabatic heating and cooling, and thus decreases the temperature difference across the regenerator, leading to increased efficiency.

As explained above, one characteristic of some Stirling engines is energy loss across the regenerator. Bypass tubes and unidirectional valves can be configured such that the regenerator can be eliminated. Because some energy is lost when the working gas passes through the regenerator, the elimination of the regenerator can reduce the loss of energy. Eliminating the regenerator also eliminates the dead volume associated with the regenerator. In this way, the compression ratios can be adjusted such that the adiabatic heated temperature of the working gas is the same as or higher than the adiabatic cooled temperature of the working gas, thus eliminating the need for a regenerator.

Figure 4:
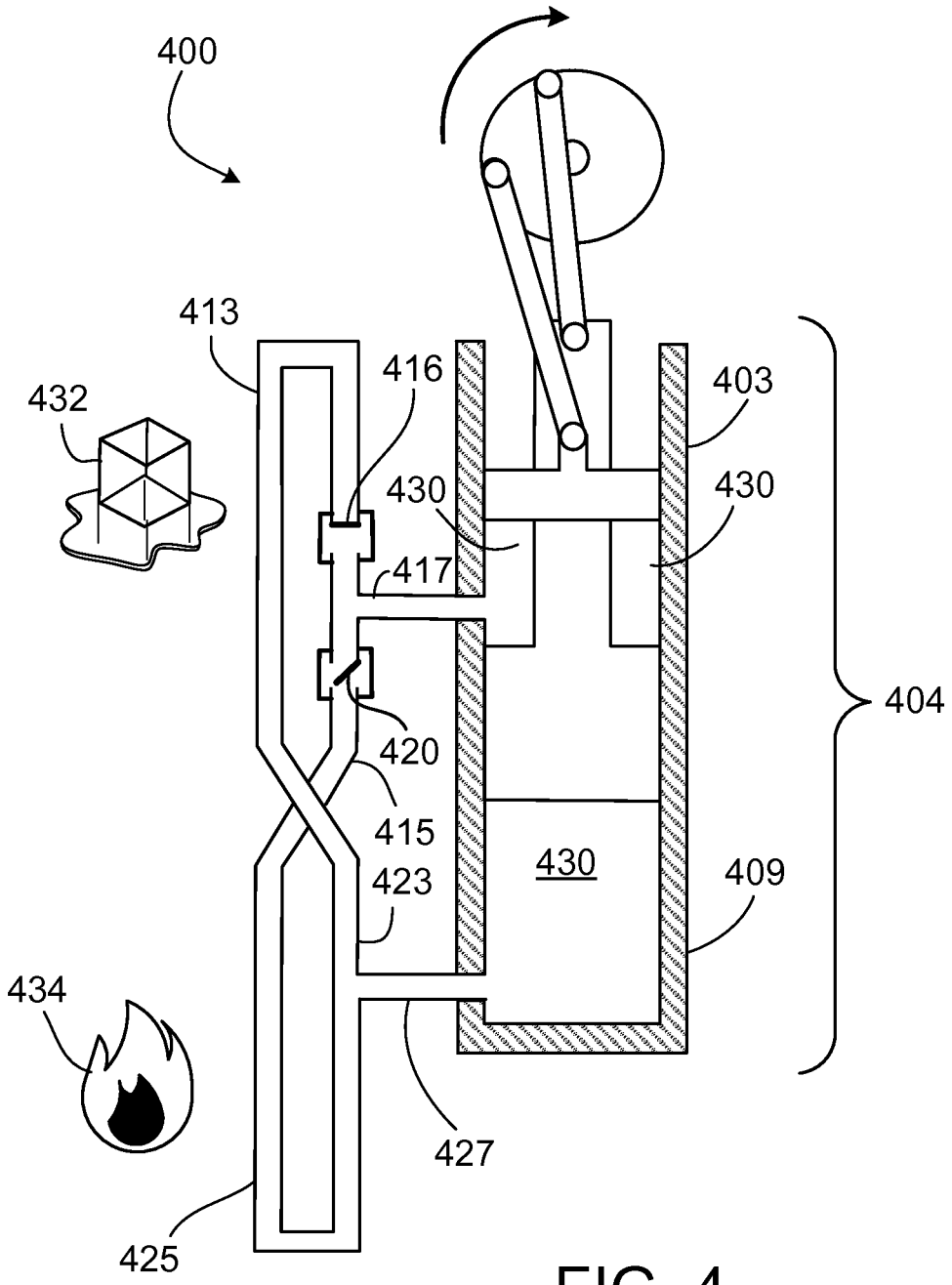
FIG. 4 shows a valved Stirling engine with a single cylinder in which the engine does not have a regenerator.

FIG. 4 shows a valved Stirling engine 400 with a single cylinder 404 such that the engine 400 does not have a regenerator. In some implementations, the cylinder 404 contains a cold portion 403 and a hot portion 409. The cold portion 403 of the cylinder 404 and the hot portion 430 of the cylinder 404 contain a working gas 430. In some implementations, the working gas 430 can flow from the cold portion 403 of the cylinder 404 to the hot portion of the cylinder 409 by way of a first connector tube 417, a first unidirectional valve 420, a heating tube section 425, and a second connector tube 427. The second connector tube 427 is connected to the hot portion 409 of the cylinder 404. The working gas 430 is heated in the heating tube section 425. The working gas 430 can flow from the hot portion 409 of the cylinder 404 to the cold portion 430 of the cylinder 404 by way of the second connector tube 427, a hot bypass tube 423, a cooling tube section 413, a second unidirectional valve 416, and the first connector tube 417, whereby the first connector tube 417 is connected to the cold portion 403 of the cylinder 404. The working gas 430 is cooled in the cooling tube section 413.

In the example shown in FIG. 4, the first unidirectional valve 420 directs a flow of working gas 430 from the cold portion 403 of the cylinder 404 towards the heating tube section 425. The first unidirectional valve 420 resists the flow of working gas from the heating tube section 425 towards the cold portion 403 of the cylinder 404. As shown in the figure, the first unidirectional valve 420 is opened, allowing the working gas 430 to flow from the cold portion 403 of the cylinder 404 towards the heating tube section 425. Because the working gas 430 flows through the heating tube section 425 the working gas 430 is heated in the heating tube section 425 by a heat source 434 on the way to the hot portion 409 of the cylinder 404. Because the working gas 430 does not flow towards the hot portion 409 of the cylinder 404 by way of the cooling tube section 413, the efficiency of the engine 400 is increased because cooling of the working gas 430 is minimized on the way to the hot portion 409 of the cylinder 404.

In some implementations, the second unidirectional valve 416 directs a flow of working gas 430 from the cooling tube section 413 towards the cold portion 403 of the cylinder 404. The second unidirectional valve 416 resists the flow of working gas 430 from the cold cylinder 430 towards the cooling tube section 413. As shown in the figure, the second unidirectional valve 416 is closed, resisting the flow of the working gas 430 from the cold portion 403 of the cylinder 404 towards cooling tube section 413. Because the working gas 430 does not flow through cooling tube section 413, the working gas 430 is thus not cooled in the cooling tube section 413 by a heat sink 432 on the way to the hot portion 409 of the cylinder 404.

Because the engine 400 does not contain a regenerator, the compression ratio of the engine 400 is increased due to the lack of dead volume of working gas in a regenerator. As a result, the temperature of the working gas 430 entering the heating tube section 425 is higher and the temperature of the working gas 430 entering the cooling tube section 413 is lower, leading to higher efficiency of the engine 400.

One advantage of placing the unidirectional valves away from the heating tube section 425 is reducing the heating of the valves. Heating the valves can increase the chance of valve failure.

The operation of the pistons and flywheel is similar to the operation of the pistons and flywheel as shown in FIGS. 3A-D and their corresponding descriptions above.

An eccentric disc, sometimes called a cam, can be used in place of a flywheel to increase the compression ratio of the engine. The compression ratio can be increased because the shape of the cam can be adjusted to maximize the ratio of the maximum volume of the working gas to the minimum volume of the working gas. Higher compression ratios results in higher engine efficiency.

Figure 5:
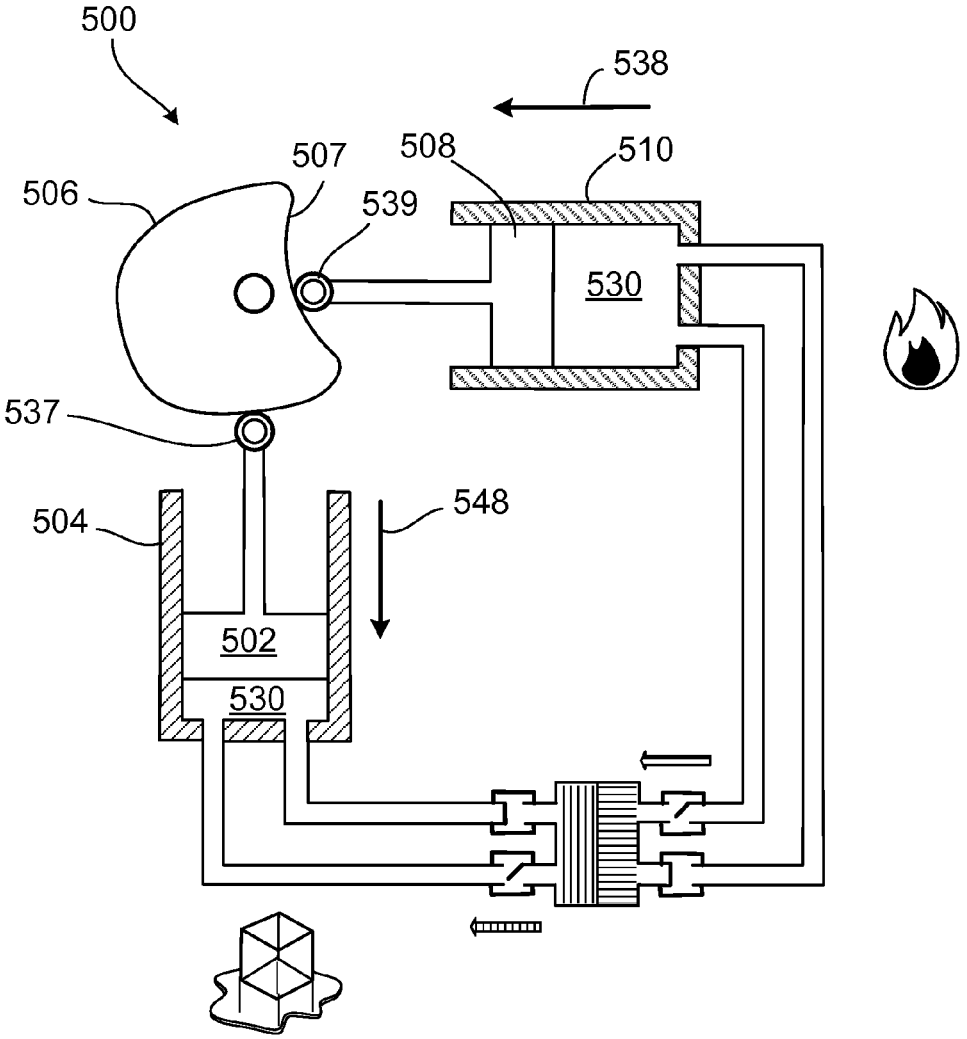
FIG. 5 shows a valved Stirling engine using an eccentric disc, sometimes called cams, in place of flywheels.

FIG. 5 shows a valved Stirling engine 500 using an eccentric disc, sometimes called a cam, in place of a flywheel. In some implementations, the engine 500 has a first piston 502 and a second piston 508. The first piston 502 is contained in a cold cylinder 504, such that the first piston 502 interacts with a cam 506. In some implementations, the first piston 502 has a first roller 537 on the end of the first piston 502 near the cam 506. The first roller 537 rolls around the circumference of the cam 506. The first piston 502 is moveable, for example, longitudinally movable, inside the cold cylinder 504. The movement can affect a working gas 530. For example, the movement may cause compression of the working gas 530. This movement also affects the cam 506. The cam 506 is moveable, for example rotationally moveable, such that the movement affects the first piston 502. The working gas 530 also affects the first piston 502. For example, expansion of the working gas 530 can cause the first piston 502 to move.

In some implementations, the second piston 508 is contained in a hot cylinder 510, such that the second piston 508 interacts with the cam 506. In some implementations, the second piston 508 has a second roller 539 on the end of the second piston 508 near the cam 506. The second roller 539 rolls around the circumference of the cam 506. The second piston 508 is moveable, for example, longitudinally movable, inside the hot cylinder 510. The movement can affect the working gas 530. For example, the movement may cause compression of the working gas 530. This movement also affects the cam 506. The cam 506 is moveable, for example rotationally moveable, such that the movement affects the second piston 508. The working gas 530 also affects the second piston 508. For example, expansion of the working gas 530 can cause the second piston 508 to move.

In some implementations, the cam 506 has a concave area 507. As shown in the figure, the first roller 537 is not within the concave area 507 and thus moved the first piston 502 in a direction 548 parallel to the longitudinal axis of the cold cylinder 504. As shown in the figure, the second roller 539 is within the concave area 507 and thus moved the second piston 508 in a direction 538 parallel to the longitudinal axis of the hot cylinder 510. As explained above, expansion of the working gas 530 can cause the pistons 502, 508 to move. This movement can affect the cam 506, for example, causing the cam 506 to rotate.

The structure and operation of the other aspects of the engine 500 is similar to the structure and operation as shown in FIGS. 1A-D and their corresponding descriptions above.

In some implementations, the compression ratio of the valved Stirling engine is increased to increase the temperature of a working gas entering the cold bypass tube and to decrease the temperature of the working gas entering the hot bypass tube. As shown above, the use of unidirectional valves and bypass tubes avoid cooling the working gas flowing to the regenerator from the cold cylinder, or portion thereof. Likewise, the use of unidirectional valves and bypass tubes avoid heating the working gas flowing to the regenerator from the hot cylinder, or portion thereof. The cam shape can be adjusted to increase the compression ratio. A higher compression ratio results in a higher temperature of adiabatically heated working gas and a lower temperature of adiabatically cooled gas, which can lead to higher efficiency. In some implementations, the compression ratio is such that the temperature of the working gas entering the cold bypass tube is the same as the temperature of the working gas entering the hot bypass tube, thus eliminating the need for a regenerator, as shown above, and increasing the efficiency of the engine. The efficiency of the engine is increased because eliminating the regenerator also eliminates the dead volume of working gas within the regenerator.

Other Stirling engine configurations are within the scope of the invention such as, for example, Gamma, Martini, Double-Acting Piston, Free Piston, and Ringborn configurations.

What is claimed is:

1. A Stirling engine apparatus comprising a set of cold bypass tubes, a set of hot bypass tubes, and at least a set of first and a set of second unidirectional valves, in which at least one heating tube of a set of heating tubes is attached to a hot cylinder and a regenerator, and wherein the at least one heating tube is configured to direct a flow of working gas through the at least one heating tube towards the hot cylinder, as regulated by at least one of the set of first and the set of second unidirectional valves.

2. The apparatus of claim 1 in which at least one cold bypass tube of the set of cold bypass tubes is attached to a cold cylinder and a regenerator, and wherein the at least one cold bypass tube is configured to direct a flow of a working gas through the cold bypass tube towards the regenerator, as regulated by at least one of the set of first and the set of second unidirectional valves.

3. The apparatus of claim 1 in which at least one cold bypass tube of the set of cold bypass tubes is attached to a cold cylinder and an at least one heating tube of a set of heating tubes, and wherein the at least one cold bypass tube is configured to direct a flow of a working gas through the at least one cold bypass tube towards the at least one heating tube, as regulated by at least one of the set of first and the set of second unidirectional valves.

4. The apparatus of claim 1 in which at least one hot bypass tube of the set of hot bypass tubes is attached to a hot cylinder and at least one regenerator of a set of regenerators, and wherein the at least one hot bypass tube is configured to direct a flow of a working gas through the at least one hot bypass tube towards the at least one regenerator, as regulated by at least one of the set of first and the set of second unidirectional valves.

5. The apparatus of claim 1 in which at least one hot bypass tube of the set of hot bypass tubes is attached to a hot cylinder and an at least one cooling tube of a set of cooling tubes, and wherein the at least one hot bypass tube is configured to direct a flow of a working gas through the at least one hot bypass tube towards the at least one cooling tube, as regulated by at least one of the set of first and the set of second unidirectional valves.

6. The apparatus of claim 1 in which a flywheel of the Stirling engine comprises an eccentric disc.

7. The apparatus of claim 1 in which a compression ratio of the engine is increased to increase a temperature of a working gas entering the cold bypass tube and to decrease a temperature of the working gas entering the hot bypass tube.

8. The apparatus of claim 7 in which the compression ratio is such that the temperature of the working gas entering the cold bypass tube is the same as the temperature of the working gas entering the hot bypass tube.

9. The apparatus of claim 1 in which a cooling tube of the Stirling engine contains at least one first unidirectional valve of the set of first unidirectional valves and at least one cold bypass tube of the set of cold bypass tubes contains at least one second unidirectional valve of the set of second unidirectional valves.

10. The apparatus of claim 1 comprising a set of regenerators arranged in parallel.

11. The apparatus of claim 1 in which the set of cooling tubes are arranged in parallel with respect to one another and the set of heating tubes are arranged in parallel with respect to one another.

12. A method for manufacturing a Stirling engine comprising:

providing a set of cold bypass tubes;

providing a set of hot bypass tubes;

providing at least a set of first and a set of second unidirectional valves;

coupling at least one of the set of first and the set of second unidirectional valves to the set of cold bypass tubes;

coupling at least one of the set of first and the set of second unidirectional valves to the set of hot bypass tubes;

providing a set of heating tubes;

coupling at least one heating tube of the set of heating tubes to a hot cylinder and a regenerator; and configuring at least one of the set of first and the set of second unidirectional valves to regulate a flow of working gas through the at least one heating tube towards the hot cylinder.

13. The method of claim 12 comprising coupling the set of cold bypass tubes to the regenerator.

14. The method of claim 12 comprising coupling the set of hot bypass tubes to the regenerator.

15. The method of claim 12 comprising:

providing a set of cooling tubes;

coupling at least one cooling tube of the set of cooling tubes to a cold portion of the hot cylinder and the regenerator; and configuring at least one of the set of first and the set of second unidirectional valves to regulate a flow of working gas through the at least one cooling tube towards the cold portion of the hot cylinder.

16. A Stirling engine apparatus comprising a set of cold bypass tubes, a set of hot bypass tubes, and at least a set of first and a set of second unidirectional valves, in which at least one heating tube of a set of heating tubes is attached to a hot cylinder, and wherein the at least one heating tube is configured to direct a flow of working gas through the at least one heating tube towards the hot cylinder, as regulated by at least one of the set of first and the set of second unidirectional valves in a closed system for the working gas.

17. The apparatus of claim 16 in which the set of cold bypass tubes are arranged in parallel.

18. The apparatus of claim 16 in which the set of hot bypass tubes are arranged in parallel.

19. The apparatus of claim 16 in which the hot cylinder comprises a cold portion and a hot portion.

20. The apparatus of claim 16 comprising at least one flywheel coupled to the hot cylinder, in which the working gas affects the at least one flywheel.

* * * * *